US008625835B2

(12) United States Patent
Gotlieb

(10) Patent No.: US 8,625,835 B2
(45) Date of Patent: Jan. 7, 2014

(54) APPAREL WITH BUILT-IN HEADPHONE EXTENSION WIRE DEVICE

(76) Inventor: Lawrence Mark Gotlieb, Encino, CA (US)

( * ) Notice: Subject to any disclaimer, the term of this patent is extended or adjusted under 35 U.S.C. 154(b) by 0 days.

(21) Appl. No.: 13/584,266

(22) Filed: Aug. 13, 2012

(65) Prior Publication Data

US 2013/0044908 A1 Feb. 21, 2013

Related U.S. Application Data

(60) Provisional application No. 61/523,326, filed on Aug. 13, 2011.

(51) Int. Cl.
*H04R 25/00* (2006.01)
*H04R 1/02* (2006.01)

(52) U.S. Cl.
USPC ..... 381/380; 2/209; 2/69; 381/388

(58) Field of Classification Search
USPC ..... 381/380; 2/100–250
See application file for complete search history.

(56) References Cited

U.S. PATENT DOCUMENTS

| | | | | |
|---|---|---|---|---|
| 4,993,065 | A * | 2/1991 | Chiou | 379/430 |
| 6,466,681 | B1 * | 10/2002 | Siska et al. | 381/372 |
| 7,519,192 | B1 * | 4/2009 | Laycock et al. | 381/301 |
| 8,280,038 | B2 * | 10/2012 | Johnson et al. | 379/430 |
| 2011/0110529 | A1 * | 5/2011 | Semcken | 381/74 |
| 2011/0299714 | A1 * | 12/2011 | Ma et al. | 381/384 |
| 2013/0095701 | A1 * | 4/2013 | Golko et al. | 439/660 |

* cited by examiner

*Primary Examiner* — Brian Ensey
*Assistant Examiner* — Norman Yu

(57) ABSTRACT

The present invention provides for the embodiments for a combined apparel and conductive extension wire assembly to bridge connectivity between a portable audio listening devices and transducers that emit audio sounds. The combined garment and extension wire assembly comprises of a garment (such as a shirt, jacket, cap, etc.) having an electrical wire with a connector on one end positioned within the interior of a garment pocket for conductive connectivity to the audio output of a portable listening device held within said pocket. The extension wire assembly shall channel through the interior of the garment through passageways or within garment seams, extending to garment apertures wherein a left and right channel wire shall respectively pass through and exit the apparel fabric having each wire ending with a connector enabling further conductive connectivity respectively to left and right channel transducers emitting audio sounds.

3 Claims, 11 Drawing Sheets

APPAREL WITH BUILT-IN HEADPHONE EXTENSION WIRE DEVICE

CROSS-REFERENCE TO RELATED APPLICATIONS

The present non-provisional patent application claims the benefit of priority filing date of U.S. Provisional Patent Application No. 61/523,326, which is entitled "APPAREL WITH BUILT-IN HEADPHONE EXTENSION WIRE DEVICE" which was filed on Aug. 13, 2011, and which is incorporated in full by reference herein.

BACKGROUND OF THE INVENTION

The invent for the merger of textiles and electronics has dated back for over a half a century when Claude Shannon and Edward O. Thorp created the first wearable computer used to predict the outcome of the gambling roulette wheel. Since then, other designers have created product that integrate electronic listening devices into apparel. One general category of designs provides for earphones that are permanently affixed to the article of clothing. While a second general category provides for the entire manual installation and removal of all electronic component parts within a garment. The present invention provides for a headphone extension wire device to be made permanently affixed to and a part of an apparel garment. The headphone extension wire device is to bridge the conductive connection between the audio output port of a personal portable electronic listening device and the stereo mini-plugs of a headphone set. Having concealed wiring configured within the confines of the garment provides a great utility to the user in that there will be no tangling of wires when using a portable listening device. Additionally, the user will avoid dangling wires that often get snagged and pulled such that the earphones become either dislodged or misaligned from the user's ears. The foregoing problem is especially prevalent with rigorous activities such as exercise, which is often a time of high preference for use of a portable listening device.

The present invention provides for the integration of electrical connectors with conductive wiring that is permanently embedded within an apparel article to provide for the interconnection between conductive elements without a break in conductivity therebetween during use. The present invention also provides for complementary electrical connectors enabling the connector joints to be broken repeatedly by attachment and detachment of the contact supporting structure of each connector.

As used herein, "earbud," "headphone" and "earphone" mean any device placed in or on the human ear for producing audible sound. As used herein, "electronic devices" means any portable electronic entertainment apparatus, such as an MP3 player, radio, television, tape or compact disc player, electronic game, multimedia computer, walkie talkie, or cellular telephone. As used herein, "apparel," "textile", "garment" and "clothing" shall mean clothing that a human being wears, such as a sweatshirt, hooded sweatshirt, jacket, hooded jacket, t-shirt, tank top t-shirt, collared shirt, hats, baseball caps, etc. This invention shall not be limited to the styles of apparel, and shall encompass any cut of cloth, fabric or material worn by a person that can feasibly encapsulate the spirit of this invention.

DESCRIPTION OF THE PRIOR ART

Wired clothing having various designs, structures and configurations have been disclosed in the prior art. Prior art does not teach or disclose the use of a headphone extension wire device of the present invention that connects to an electronic device held within a pocket to a garment on the one end, and to headphone mini plugs on the other end having the design, structure and configuration of the present invention.

Accordingly, it is an object of the present invention to provide a headphone extension wire device made permanently apart of and embedded within an apparel garment. It is a further object of the present invention to resolve problems faced with prior art as well as improve upon prior inventions by providing further utilities to the user that the prior art cannot offer.

An example of wired clothing having various designs, structures and configurations shall been disclosed in the prior art for, U.S. Pat. No. 8,107,653 to James Wolfe (Venice, Calif.) that discloses wired clothing that houses earbuds and wiring within a hooded garments, wherein the wiring apparatus and earbuds are permanently affixed and/or embedded within a hooded garment.

The disclosure of the Wolfe invention embodies the entire wire with earbud apparatus to be permanently affixed to the garment. Such method is problematic in that it does not provide for an economically reasonable means to repair or replace broken wires or when a transducer speaker no longer functions. Repairing the speaker by replacement is impractical and often cost prohibitive relative to the inexpensive garment product as a whole. With no reasonable means to repair or replace a broken speaker, the garment is rendered to be no more than a regular article of clothing, and thereby loses perhaps its greatest functionality and differentiating attribute. The present invention alleviates the problem of broken speakers as the speaker itself is not permanently affixed to the apparel, and may effortlessly be interchangeable with a working replacement.

The Wolfe invention having apparel with permanently built-in earphones may be problematic for the consumer inasmuch as the length of the wire may not be desirable (the wire that extends from the earbud to the exit point from within the apparel at the neckline). The present invention alleviates this potential annoyance, as the consumer may have selective variations of the length of the wire and choose an optimal length for comfort and appearance. As well, the consumer may have choice not to connect any headphone attachment when wearing the apparel and not using a listening device.

Apparel with permanently built-in earphones is restrictive in its maintenance. Current technology for earbuds is such that the earbud itself, while may be made to be waterproof, still remains sensitive to heat temperatures. By permanently affixing the earbuds to the garment, the textile will likewise be restrictive to heat inasmuch as the garment may only be washed and dried with restrictively low temperatures to protect the integrity of the permanently attached earbud. The present invention alleviates the restrictive nature of the current product as the headphones are removable from the apparel and the garment itself may be separately washed and dried at varied degrees of temperatures without the threat of damage to the speakers.

A second example of prior art is U.S. Pat. No. 7,519,192 to Logan Laycock, Landon Laycock and Larry R. Laycock (Alpine, Utah), that discloses wired clothing that houses headphones and wiring within a hooded garments, wherein the entire wiring apparatus including the earbuds affixed to the wiring, may be removed in its entirety. Such method is cumbersome and may be a great annoyance to the user as each time the wire assembly is to be removed, the user must reassemble the wiring by threading and fastening the passageways. In practice the garment will likely require the turning of the garment inside-out to accomplish the threading and reassembling of the wiring, and take an extensive period of time with undue frustration.

In addition to the problems resolved for prior art, another object of the present invention is to provide further utilities to the consumer by allowing for the removal of the headphone attachment assembly. A great benefit is offered to the consumer by providing quality choice selection for the speakers, and aesthetic variety wherein prior art patents do not disclose the design, structure and configuration of the present invention.

The detachable headphone attachment assembly provides a consumer with choice of style of headphones whether it be earbuds, over-the-ear headphones, on-ear headphones, sports headphones, or other design configurations now known or to be developed. As well, having the detachable feature from the garment provides to the user with the ability to use the headphones on their own, or with other garments styles of the present invention. This feature becomes more relevant upon expending a high cost for high quality expensive earphones.

In recent years many companies have come to market various designs for their earbuds. Many consider the earbud as a fashion accessory, and the multitude of designs variations in the marketplace reflect demand for aesthetic selection of the earbud. The present invention would allow for the consumer with choice and opportunity to provide change for the overall look of the clothing, by making available different earbud and lanyard designs and colors that may accessorize the garment.

SUMMARY OF THE INVENTION

The present invention provides for a headphone extension wire device made permanently affixed to and a part of an apparel garment. The headphone extension wire device includes an elongated cable wire having a first end to be connected to audio output port of a portable electronic listening device and a dual second end consisting of a left ear headphone connector port, and right ear headphone connector port. The headphone extension wire device on the first end shall have a male connector held within a pocket of the apparel garment that shall be dedicated to carry a portable electronic listening device. The dual connector ports on the other end of the extension wire shall be suspended outside the garment, and shall be used to receive the complementary connection jacks of a left transducer and right transducer of an accessory headphone attachment assembly. Additionally, the extension wire shall be configured to allow for the attachment of an earphone with microphone assembly to be used with a cellular telephone. Between the ends of the extension wire device will be the conductive wiring comprising of a right channel wire and left channel wire that shall be permanently affixed to the interior of the garment.

BRIEF DESCRIPTION OF THE SEVERAL VIEWS OF THE DRAWING

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT

Figure 2A:
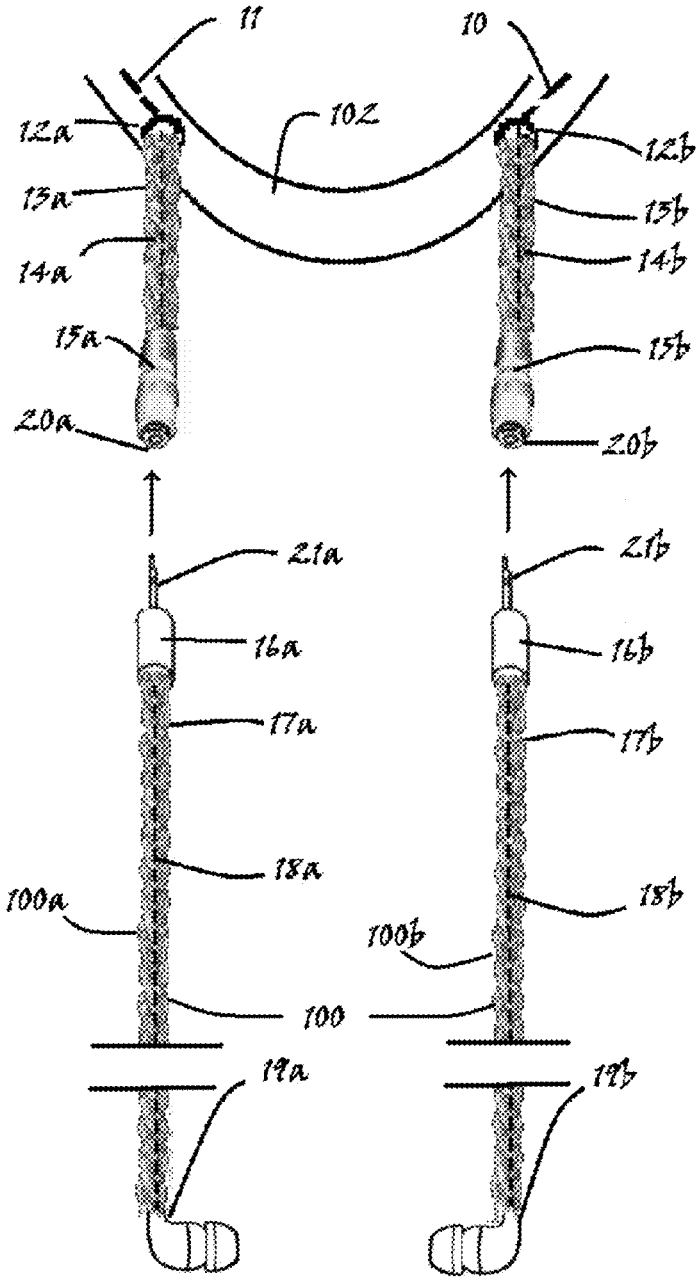
FIG. 2A illustrates a partial front view of the garment showing the left earphone and right earphone connecting ports of the extension wire device and the headphone attachment assembly exemplified with earbuds.
Figure 2B:
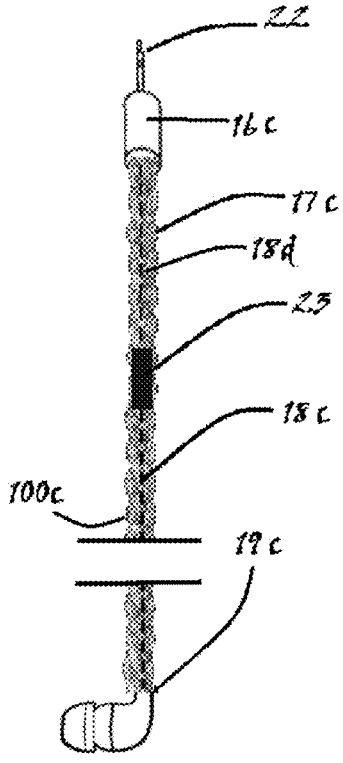
FIG. 2B illustrates an alternative headphone attachment assembly incorporating a microphone and earbud speaker attachment device intended for use with a hands-free cellular phone.
Figure 3:
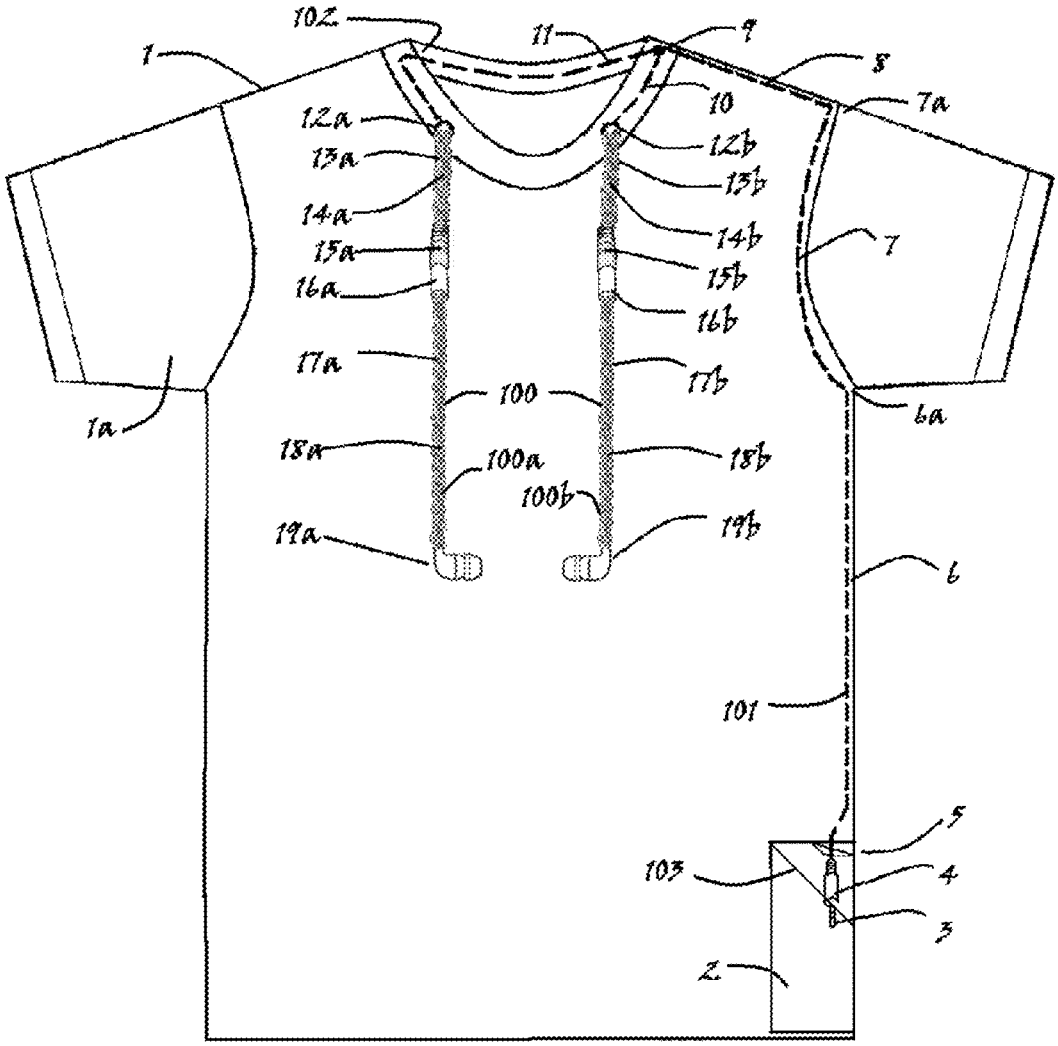
FIG. 3 illustrates a front view of an exemplary garment with the embedded headphone extension wire device with an attached headphone attachment assembly according to the preferred embodiment of the invention.
Figure 4:
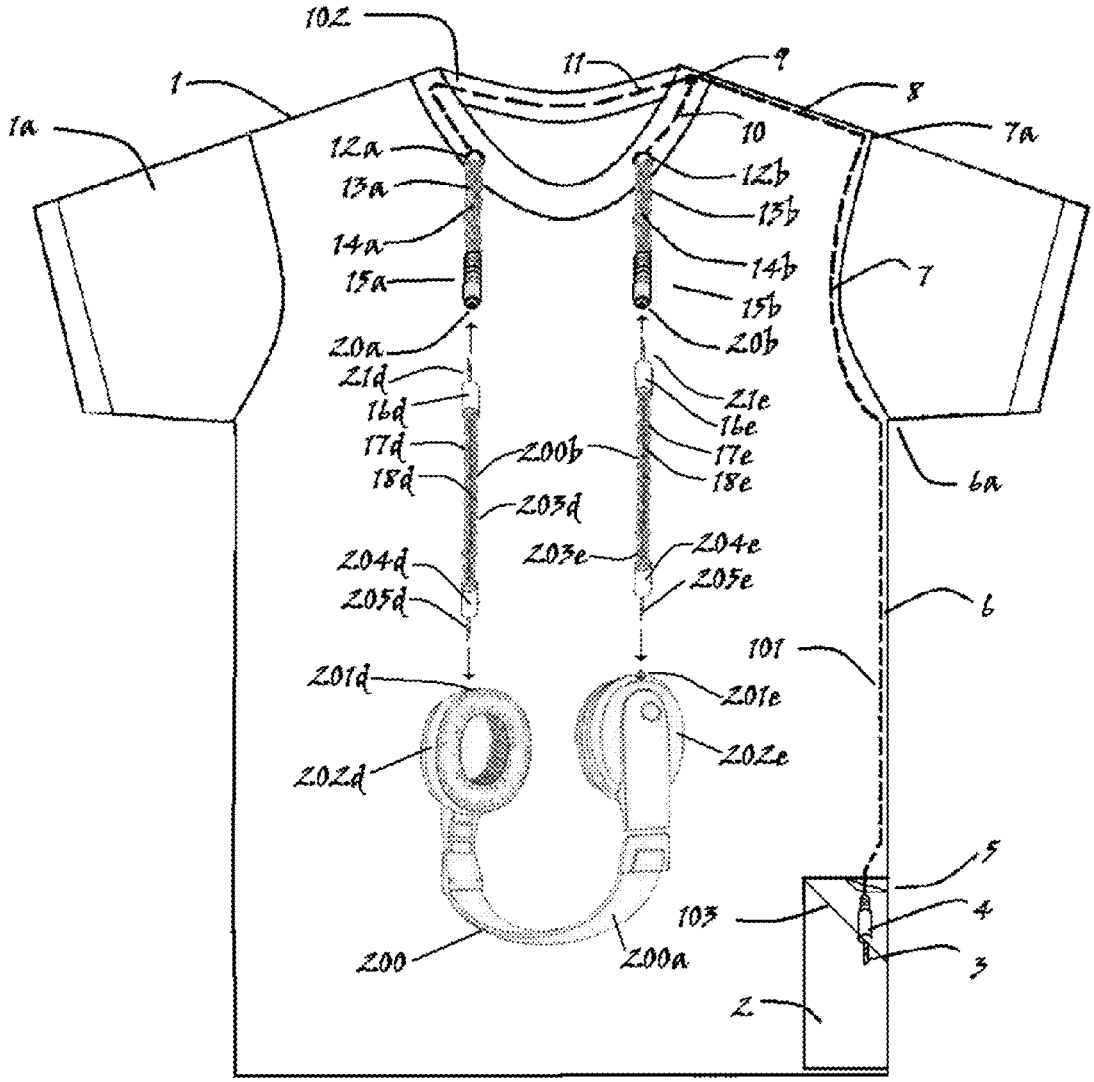
FIG. 4 illustrates a front view of an exemplary garment with the embedded headphone extension wire device with a method to attach over-the-ear headphones according to an embodiment of the invention.

The combined apparel with embedded headphone extension wire device 1 and its component parts of the preferred embodiment of the present invention are represented in detail by FIGS. 1 through 8 of the drawings. The present invention consists of three component part categories that combine together for the preferred embodiment of the combined apparel with embedded headphone extension wire device 1, namely, (1) apparel item 1*a*, (2) extension wire device 101 and (3) headphone attachment assembly (100 as illustrated in FIG. 2A; 200 as illustrated in FIG. 4).

The first component part category of apparel is exemplified in FIGS. 1 through 8 of the drawings as a t-shirt 1*a*. Although garment 1*a* is portrayed in FIG. 1 through 8 as a t-shirt, garment 1*a* may include any clothing that a human being wears, such as a sweatshirt, hooded sweatshirt, jacket, hooded jacket, t-shirt, tank top t-shirt, collared shirt, overalls, swimwear, wetsuit, hats, baseball caps or any cut of cloth that can feasibly encapsulate the spirit of this invention. The garment 1*a* shall be designed to include a pocket 2 to hold a portable electronic listening device, such as an MP3 player, cellular telephone, walkie talkie, etc.

Figure 1:
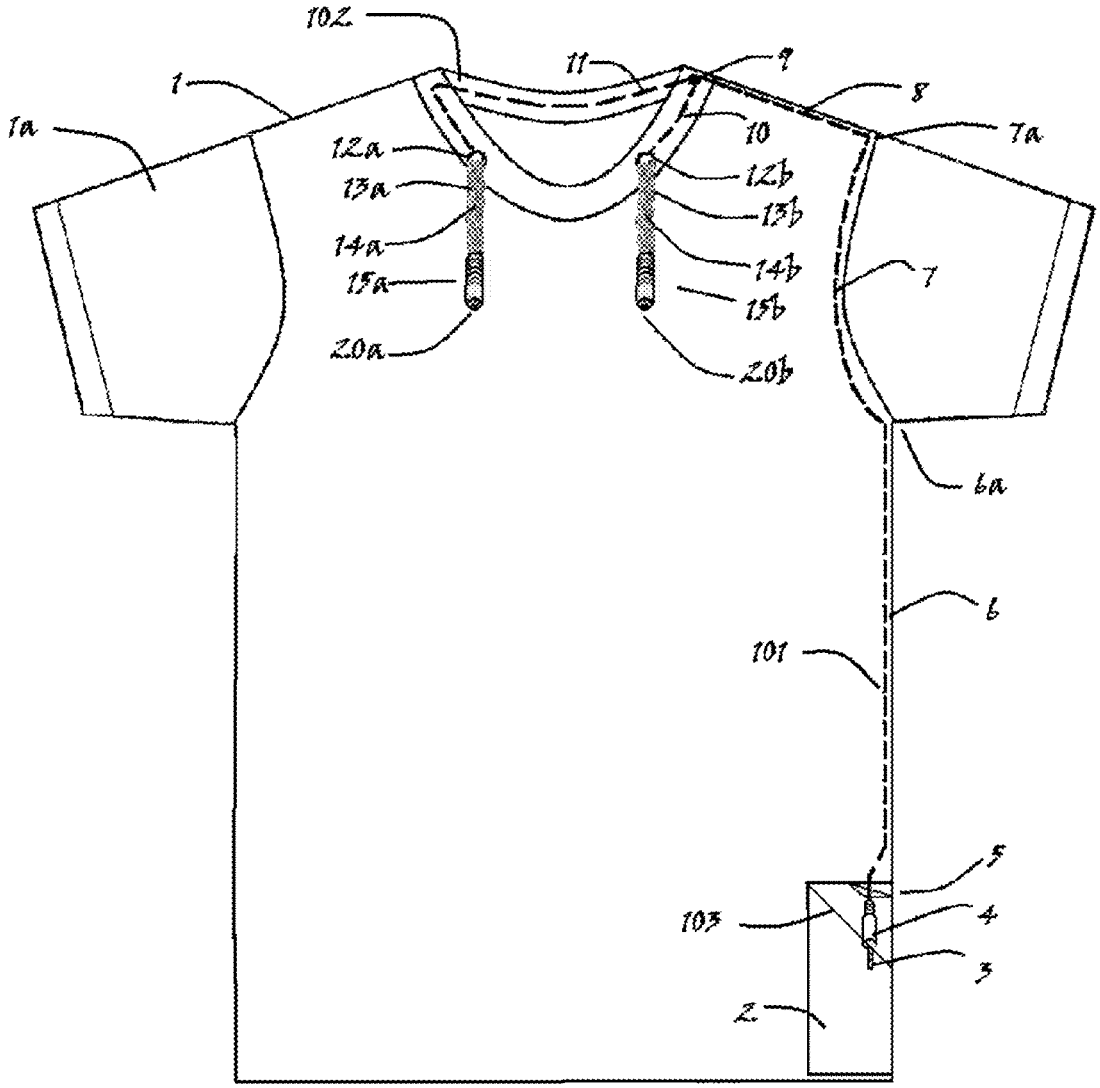
FIG. 1 illustrates a front view of an exemplary garment with the embedded headphone extension wire device according to the preferred embodiment of the invention.

Garment pocket 2 is exemplary in nature, and is depicted on garment 1*a* of the embodiment of FIG. 1 through 8 of the drawings on the exterior left side bottom portion of the garment (where all references to left and right is from the perspective of the user). Pocket 2 may be positioned elsewhere on garment 1*a* and be configured in such a manner consistent with the present invention. The pocket 2 on the apparel is configured to be sized in a manner large enough to be consistent to hold a portable electronic listening device. Pocket 2 is exemplary in nature, and may be designed with an opening on the top or side of the pocket which will allow for the ingress/egress of a portable electronic listening device. Alternatively, pocket 2 may be configured with a means of open and closure of the pocket by design of a zipper, Velcro® (Registered Trademark), or as in one embodiment, with a flap 103 as shown in FIG. 1. The flap 103 may be unsecured or secured by a latching device such as a button, magnet, Velcro® or the like, not illustrated in FIG. 1.

For garments comprising of a style with a hood, such as a hooded sweatshirt, hooded jacket, hooded t-shirt, etc., such articles of clothing typically are constructed with a drawstring to control the opening and closing of the hood's opening surrounding the user's face when the hood is positioned to cover the user's head. For hooded garments, the drawstrings are a functioning aspect of the garment, independent from the present invention. The present invention shall be configured in hooded garments, separate and apart from any drawstrings for the hood, and shall operate independently from the hood's drawstrings.

The second component part category of the present invention is the extension wire device 101 as illustrated in FIGS. 1 through 8 of the drawings. The extension wire device 101 shall comprise on one end with connector jack 4 to be inserted into the output audio port of a portable listening device. The other end of the extension wire device shall comprise of a right connector jack 15*a* and left connector jack 15*b* that will be used to connect to the headphone attachment assembly 100 or 200 (more fully described below). Between the ends of the extension wire device shall be a conductive cable consisting of a left channel wire and right channel wire, and be configured with the apparel as illustrated in FIGS. 1 through 8 of the drawings.

The third component part category of the present invention is the headphone attachment assembly 100 or 200. The headphone attachment assembly shall consist on one end with a right 16*a*, 16*d* and left 16*b*, 16*c*, 16*e* connector jacks and on the other end shall respectively consist of a right 19*a*, 202*d* and left 19*b*, 19*c*, 202*e* transducer that shall emit sounds. The ends shall be joined together by a conductive electrical wire. Illustrated in FIGS. 2A, 2B, and 3 are transducers 19*a*, 19*b*, 19*c* that are inserted into the user's ear canal and are commonly known as earbuds. Illustrated in FIG. 4 are transducers 202*d*, 202*e* that are placed over the user's ears and are commonly known as over-the-ear headphones 200*a*. The transducers illustrated in FIGS. 2A through 4 are exemplary and other styles of transducers that emit sounds may be configured and designed in such a manner consistent with the present invention including on-ear headphones, sports earbuds, clip earbuds, and the like.

All lanyards 13*a*, 13*b*, 17*a*, 17*b*, 17*c*, 17*d*, 17*e* illustrated in FIGS. 1-9 provide for nothing other than aesthetic appeal. The current invention may be constructed without having the lanyard house any of the corresponding wiring and shall function no differently.

Figure 9:
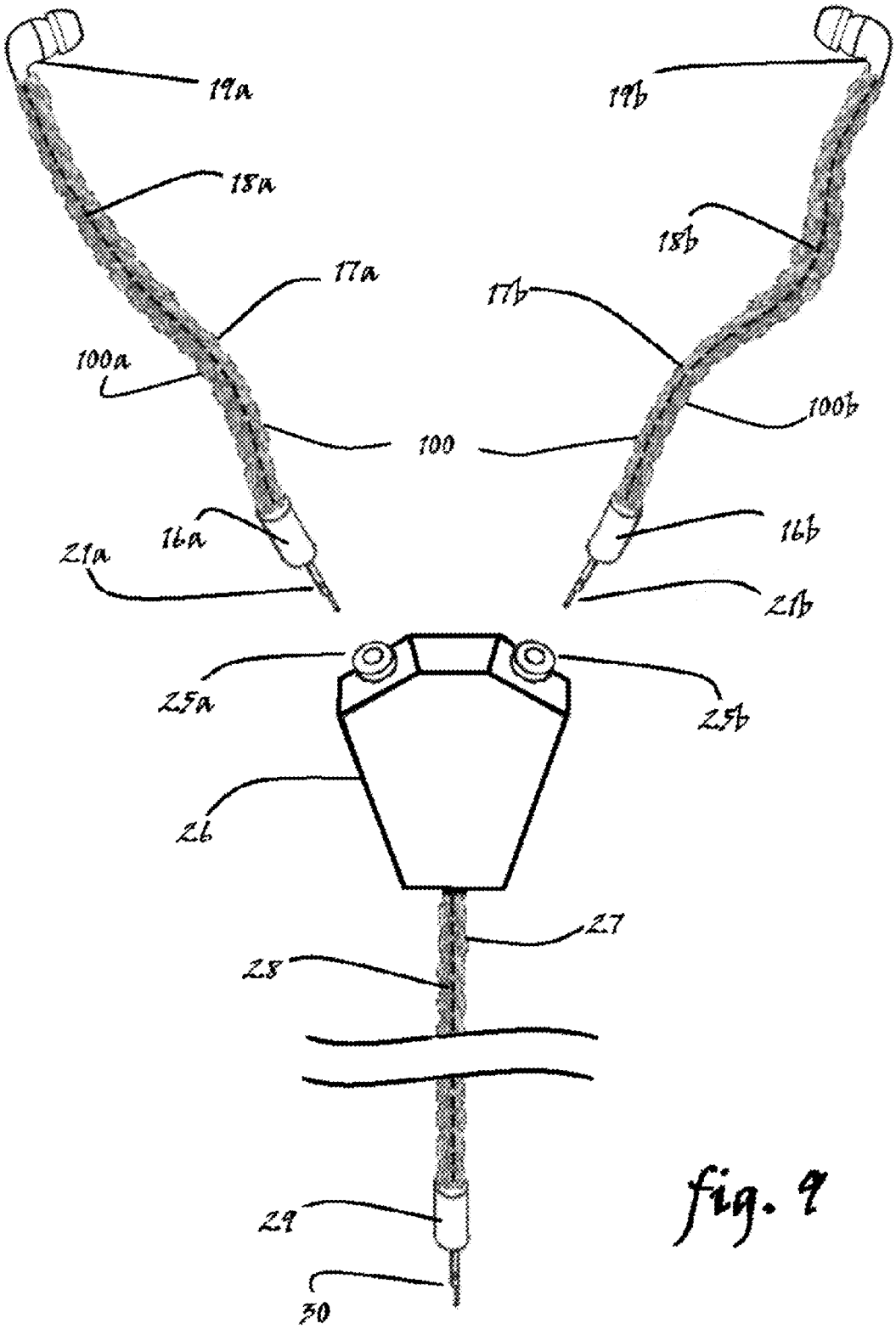
FIG. 9 illustrates the headphone attachment assembly method of connecting to a 'Y' adapter device, to be used as a listening device separate and apart from the garment.

FIG. 9 is an illustration of an alternative use for the headphone attachment assembly 100 separate and apart from use with the headphone extension wire device embedded within the garment 1.

FIG. 1 illustrates a combined garment and embedded headphone extension wire device 1, in accordance with the present invention. To operate, the garment and headphone extension wire device 1 will require the connection of an headphone attachment assembly 100, not shown in FIG. 1, and discussed in greater detail below. The combined garment, headphone extension wire device 1 shall include an embedded headphone extension wire device 101, which shall permanently be affixed and made a part of the garment and shall be described in greater detail below. To fully operate and produce audio sounds he combined garment, headphone extension wire device 1 shall require an headphone attachment assembly 100 comprising of a right earphone assembly 100*a* and a left earphone assembly 100*b*, as illustrated in FIGS. 2A, 3 and described in greater detail below. Alternatively, the combined garment, headphone extension wire device 1 may operate with over-the-ear headphone attachment assembly 200 comprising of a right earphone transducer 202*d* and a left earphone transducer 202*e*, as illustrated in FIG. 4 and described in greater detail below.

In one embodiment, as show in FIG. 1, having the pocket 2 on the exterior of the garment, a cutting of the interior fabric creating slit 5 is to allow for the threading of the male jack connector 4 and a portion of the extension wire 6 of the headphone extension wire device 101 to the interior of the pocket 2. Headphone extension wire device 101 may be comprised on one end with a male headphone jack connector 4, comprised of a 3.5 mm TRRS (Tip, Ring, Ring, Sleeve) 4 conductor male plug 3 format. Further description of the male jack connector 4 is discussed below. Connector 4 shall be threaded from within the interior of the garment, through slit 5 and loosely be held within the interior of the pocket 2.

It is not intended that connector 4 be restrictive to only a 3.5 mm TRRS format and other connector configurations may be employed including but not limited to a 3 conductor TRS connector, 2.5 mm jack sizing, and any other type of connector, now known, or to be commonly employed in the future, for the purpose of connecting the audio output port of a portable listening device to the headphone extension wire device 101.

In one embodiment of this invention, as show in FIG. 1, a cable 6 comprising of two conductive electrical wires, having one wire designated for the right channel, and the second wire designated for the left channel shall connect from the male jack plug connector 4 thread through slit 5 and be sewn into the fabric of the seem to garment 1*a* on the left side. At the point where the lower portion of the sleeve meets with the left side seem 6*a*, the wire shall continue therefrom and be sewn into the seem of the sleeve on the back left side of the garment 7. At the point where the top portion of the sleeve meets with the top left shoulder seem 7*a*, the wire shall continue therefrom and be sewn into the seem of the shoulder on the garment's top 8 and extend until the point where the dual wire shall separate into two single wire extensions within the top left section of the garment's collar 9.

In a different embodiment of the invention, not herein shown, additional fabric may be sewn and affixed to the interior of the garment 1*a* to create an internal passageway into which the wire of the headphone extension wire device shall be threaded and held on the left side of the garment and similarly follow the path of sewn-in wire 6, 7, 8.

In a different embodiment of the invention, not herein shown, the fabric pattern of the garment 1*a* may strategically be cut longer on one end such that when sewn at the seems an elongated fabric will be on the inside of the garment 1*a*. Said elongated fabric shall be folded and sewn at the seem line thus creating an elongated passageway into which the headphone extension wire 101 may be threaded.

The configuration of the path of wire extension device 101 in FIG. 1 is one embodiment of the invention. The extension wire device 101 may be configured to take on a different path on the interior of the garment 1*a* dependant on the cut pattern of the garment 1*a*, and the choice placement for pocket 2.

In one embodiment of the invention, as show in FIG. 1, the garment's 1*a* collar 102 is comprised of sewn fabric to the body of the garment 1*a* at the neckline, wherein there is a folded fabric creating an outer fabric surface of the collar fabric, inner fabric surface of the collar, and a hollowing within the fold creating the inner surface. That portion of wire 8 of the headphone extension wire 101 is threaded through to the interior hollowed surface of the garment collar 102 wherein the dual wire is split into two individual wires at the split point 9. Also, at the split point 9 a securing device will be applied to ensure that the wires do not further separate.

Extending from the split point 9, is the single left side extension wire section 10 that is threaded inside the hollowing inner surface of the collar 102 on the left side neck line of collar 102. The exterior fabric of collar 102 on the left side will have an exit hole 12*b* from which left extension wire section 10 will exit collar 102 and continue within the left hollowed lanyard 13*b*. Left wire section 14*b* shall continue within the hollowing of the lanyard 13*b* from the hole 12*b* and end by connecting to the left female connector 15*b*. The left female connector 15*b* shall consists of a TRS female connector port 20*b* that will allow for the left audio channel of the left part of the headphone attachment assembly 100*b* to be connected (as illustrated in FIG. 2A). Headphone attachment assembly 100*b* may be substituted with headphone attachment assembly 100*c* for use with a cellular telephone. The configuration of headphone attachment assembly 100*c* is discussed in greater detail below. (see FIG. 2B)

Extending from the dual wire split point 9, is the right extension wire section 11 that is threaded inside the hollowing inner surface of the collar 102 and is threaded through the collar 102 and extend through the back of the garment collar portion in the neckline and continue around the neck and turn and follow towards the front right side of the collar 102. The exterior fabric of collar 102 on the front right side will have an exit hole 12*a* from which right extension wire section 11 will exit collar 102 and continue embedded within the right hollowed lanyard 13*a*. Right wire section 14*a* shall continue within the hollowing of the lanyard 13*a* from the hole 12*a* and end by connecting to the right female connector 15*a*. The right female connector 15*a* consists of a connector that will allow for the right audio channel of the headphone attachment assembly 100*a* to be connected (as illustrated in FIG. 2A).

In another embodiment of the invention not herein illustrated, cut patterns different than garment 1*a* may not include a collar 2. Such embodiments of the invention will utilize an extra fabric sewn to the inside of garment that shall be folded with the side ends sewn creating a hollowed passageway for which the extension wire device 101 may be threaded around the neck of the user. The added fabric shall be sewn into the inside of the garment near the user's neck, and the wiring of the extension wire device 101 shall be threaded within the hollowing of the extra fabric and follow a similar path as that created by collar 102 for the portions of wire 9, 10, 11.

As illustrated in FIG. 1 the right and left female connectors 20*a* and 20*b* respectively, will be configured to allow for the connection of a 3.5 mm TRS conductor male jack. The Tip Ring Sleeve format on each connector will allow for use of a earphone attachment assemblies 100*a*, 100*b* as illustrated in FIG. 2A. It will also allow for the connection of earphone/microphone attachment 100*c* as illustrated in FIG. 2B. Alternatively, the right and left connector 15*a*, 15*b* may be configured with a male jack which will in turn require the complementary connectors on the headphone attachment assembly 16*a*, 16*b* be configured with corresponding female connector ports to allow for connectivity (not illustrated in the figures).

Figure 1A:
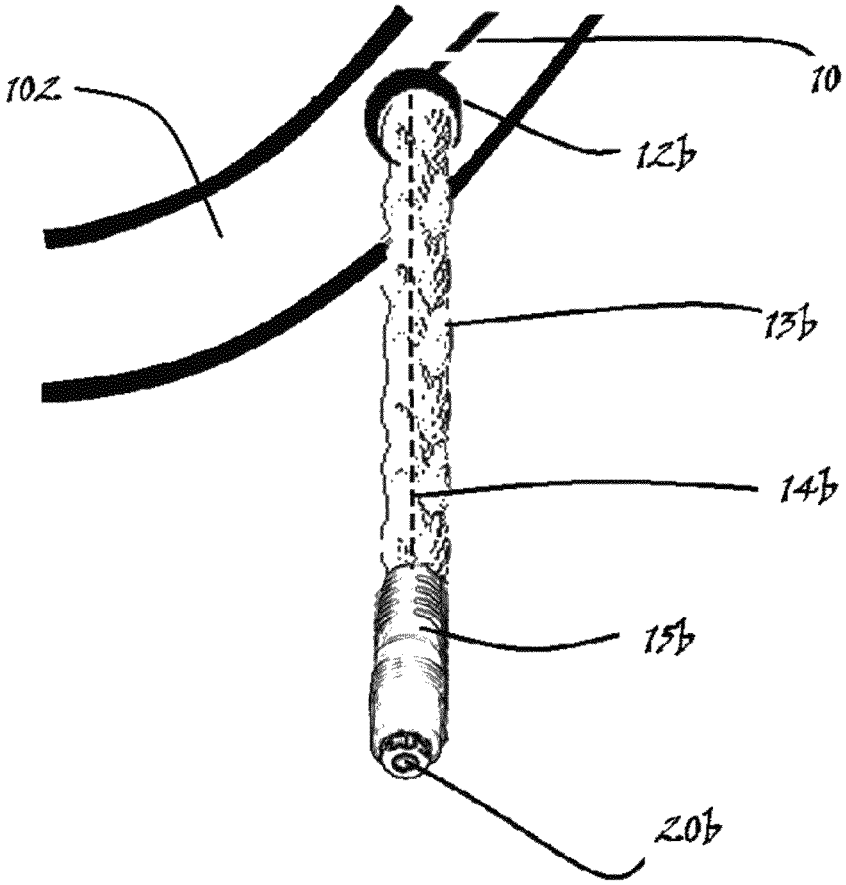
FIG. 1A illustrates a partial front view of an exemplary garment near the neckline showing one of the two connecting ports of the headphone extension wire device.

FIG. 1A illustrates a partial view of the left section of the extension wire device from the point of the embedded left channel wire 10 within collar 102, and ending at the left female connector 15*b*. Lanyard 13*b* shall permanently be affixed on one end (by sewing or otherwise) to the interior hollowing of collar 102 close to the exit hole 12*b*. Lanyard 13*b* shall extend through the hole 12*b* and continue and end at connector 15*b*. Left wire section 10 of the extension wire device 101 shall thread through the open end of the lanyard 13*b* that is within collar 102. Left wire section 14*b* shall continue through the hollowing of the lanyard 13*b* and attach and be connected to connector 15*b*. Left female connector 20*a*, will be configured to allow for the connection of the male jack of the headphone attachment assembly 100*b* (or 100*c* for cellular telephone applications). This portion of the left extension wire assemble described herein for FIG. 1A, will have an equivalent configuration for the right side (not herein shown).

Figure 1B:
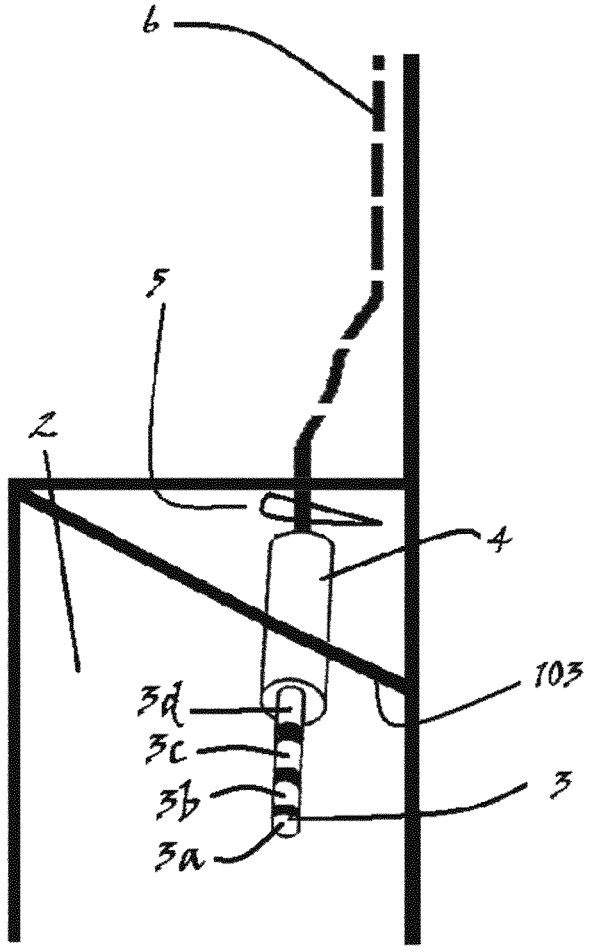
FIG. 1B illustrates a partial front view of garment showing the extension wire connector jack within a pocket. It further illustrates a slit in the fabric on the inside of the pocket wherein the connector jack and connected wire is threaded through to the interior of the pocket.

FIG. 1B illustrates a partial view of the garment pocket 2 containing the male connector 4 held within the pocket 2 and connected to extension wire device 101 at wire section 6 that is threaded through the interior slit hole 5, and leading extension wire section 6 up the left side of the garment. Male jack 3 is configured with a TRRS (Tip, Ring, Ring, Sleeve) 4 conductor jack having a tip 3*a* to connect to the left channel wire and speaker, first ring 3*b* to connect to the right channel wire and speaker, the second ring 3*c* to act as the common ground for both the left and right channels, and the sleeve 3*d* to connect to the microphone 23, when used in conjunction with headphone attachment assembly 100*c* (as illustrated in FIG. 2B). TRRS male connector jack 3 is exemplary in nature, and in other embodiments may be configured differently such as a TRS (Tip, Ring, Sleeve) format, 2.5 mm connector jack, or other variations that would be consistent with the use of a portable electronic listening device. Pocket flap 103 is exemplary in nature and the configuration of pocket 2 may take on different designs (as previously stated).

FIG. 2A illustrates a partial view of the earphone extension wire device 101 at the collar 102 of the garment and the detached headphone attachment assembly 100. The headphone attachment assembly 100 comprises of a right earphone attachment 100*a* and a left earphone attachment 100*b*. For operation of audio only, both the right 100*a* and left 100*b* earphone attachment assemblies are constructed in the same manner. At one end of the assembly is the transducer that emits audio sounds and is exemplified in FIG. 2A as an earbuds 19*a* (on right side), 19*b* (on left side). Attached to the earbuds 19*a*, 19*b* are lanyards 17*a*, 17*b* (respectively) that will be made of various lengths to provide the user with choice and comfort for their personal preferences. The lanyards 17*a*, 17*b* shall respectively extend from the earbuds 19*a*, 19*b* until the male connector on the other end of each assembly 16*a*, 16*b* (respectively). Threaded within the lanyard 17*a*, 17*b* is the conductive wiring 18*a*, 18*b* (respectively) of the headphone attachment assembly 100 that will attach and bridge the electrical connection between the earbuds 19*a*, 19*b* and the male connectors 16*a*, 16*b* (respectively). The male connector 16*a*, 16*b* will comprise of connector jacks 21*a* 21*b* (respectively). Assembly of the right headphone attachment assembly 100*a* will require the insert of the jack 21*a* into the complementary right earphone extension wire female connector 20*a*. Assembly of the left headphone attachment assembly 100*b* will require the insert of the jack 21*b* into the left earphone extension wire female connector 20*b*.

FIG. 2B illustrates the headphone attachment assembly 100*c* that encompasses the feature of a microphone 23 to be used as a hands free cellular listening and speaking device. The headphone attachment assembly 100*c* comprises of an transducer that emits audio sounds 19*c* and is exemplified in FIG. 2B as an earbud. Attached to the earbud 19*c* is a hollowed lanyard 17*c* that will be made of various lengths to provide the user with choice and comfort for their personal preferences. The lanyard 17*c* shall extend from the earbud 19*c* until the male connector 16*c* on the other end of the assembly. Threaded within the lanyard is the conductive wire 18*c* that will provide the electrical connection between the earbud 19*c* to the microphone 23 that is embedded within the lanyard 17*c*. The microphone 23 will have the function of transmitting audio sounds for the application of speaking into the cellular telephone when a cellular telephone is used as the portable electronic device for the combined apparel with embedded headphone extension wire device 1. Extending from the microphone 23 is an electrical wire 18*d* that will provide the electrical connection between both the earbud 19*c* and microphone 23 to the male connector 16*c*. The male connector 16*c* will comprise of a TRS connection pin that will allow for audio sounds to travel to the earbud and the use of transmitting audio sounds from the microphone 23 to the cellular telephone. Assembly to the combined apparel with embedded headphone extension wire device 1 of the earphone/microphone attachment assembly 100*c* will require the insert of the male jack 22 into the earphone extension wire complementary female connector 20*b*.

FIG. 3 illustrates a combined apparel with embedded headphone extension wire device 1 exemplified with a t-shirt garment 1*a*, embedded extension wire device 101, and applied connection of the headphone attachment assembly 100, in accordance with the present invention.

FIG. 4 illustrates a combined apparel with embedded headphone extension wire device 1 exemplified with a t-shirt garment 1*a*, embedded extension wire device 101, and disassembled over-the-ear headphone attachment assembly 200, in accordance with the present invention. Over-the-ear headphone attachment assembly 200 will be comprised of an over-the-ear headphone set 200*a* featuring a right and left transducer that emit sounds 202*d*, 202*e* (respectively). Over-the-ear headphone attachment assembly 200 also will be comprised of a set of two headphone extension wires 200*b* that will bridge connectivity between the over-the-ear headphones 200*a* and the extension wire device 101 of the preferred embodiment of the invention. The right headphone wire extension wire 203*d* and left headphone extension wire 203*e* will each be configured in the same manner when the over-the-ear attachment assembly 200 is used for listening only. For utilization of a cellular telephone (not illustrated in the drawings) the left extension wire 203*e* may be substituted with another extension wire that utilizes a built-in microphone and configuring said microphone similarly to the configuration of microphone 23 within headphone attachment assembly 100*c* (as illustrated in FIG. 2B). The right extension wire 203*d* will be comprised of two male connectors 16*d*, 204*d* one on each end of the extension wire 203*d*. Connector 16*d* shall be configured with a male jack 21*d* to be inserted to the complementary female connector 15*a* of the extension wire device 101. In another embodiment of this invention the right connector 15*a* of the extension wire device 101 may be constructed with a male jack, thereby requiring complementary connector 16*d* to be constructed with a female connector to provide for the proper connection. Right extension wire connectors 21*d*, 204*d* will be joined together by a conductive electrical wire 18*d* that is embedded within the hollow of a lanyard 17*d*. Right extension wire connector 204*d* will be configured with a male jack 205*d* and shall make its electrical connection by insert into the female connector port 201*d* of the right transducer 202*d* of the over-the-ear headphones 200*a*. The left extension wire 203*e* shall be similarly constructed, configured, connected, and function as its counterpart extension wire 203*d* on the right side (having the left over-the-ear headphone attachment assembly parts 21*e*, 16*e*, 17*e*, 18*e*, 204*e*, 205*e*, 201*e*, 202*e* respectively correspond with the right side counterparts 21*e*, 16*e*, 17*e*, 18*e*, 204*e*, 205*e*, 201*e*, 202*e*).

Figure 5:
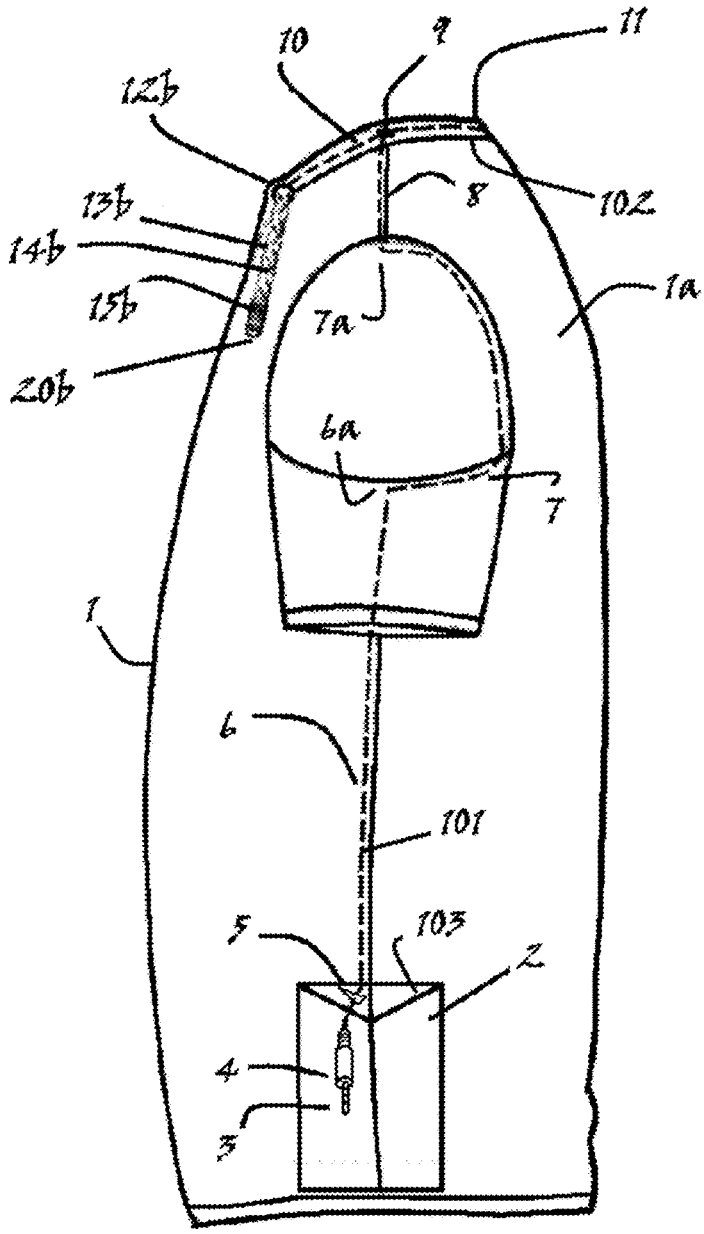
FIG. 5 illustrates a left side view of an exemplary garment with the embedded headphone extension wire device according to an embodiment of the invention.

FIG. 5 illustrates a left side perspective view of the combined apparel with embedded headphone extension wire device 1 exemplified with a t-shirt garment 1*a*, embedded extension wire device 101, in accordance with the present invention.

Figure 6:
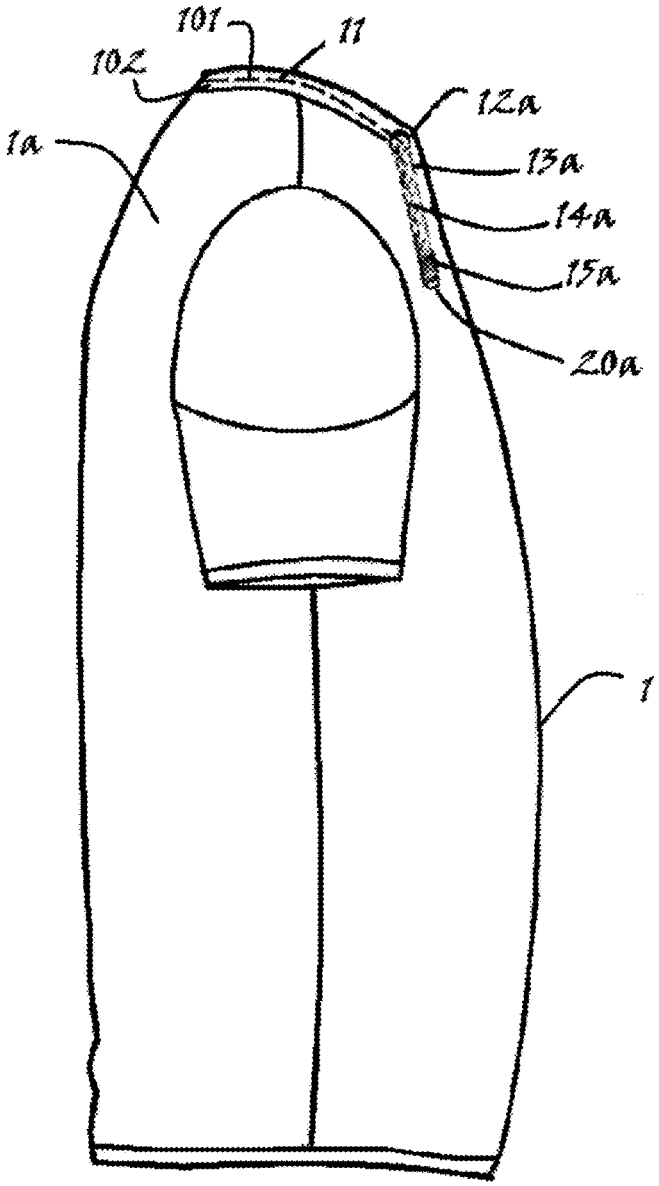
FIG. 6 illustrates a right side view of an exemplary garment with the embedded headphone extension wire device according to an embodiment of the invention.

FIG. 6 illustrates a right side perspective view of the combined apparel with embedded headphone extension wire device 1 exemplified with a t-shirt garment 1*a*, embedded extension wire device 101, in accordance with the present invention.

Figure 7:
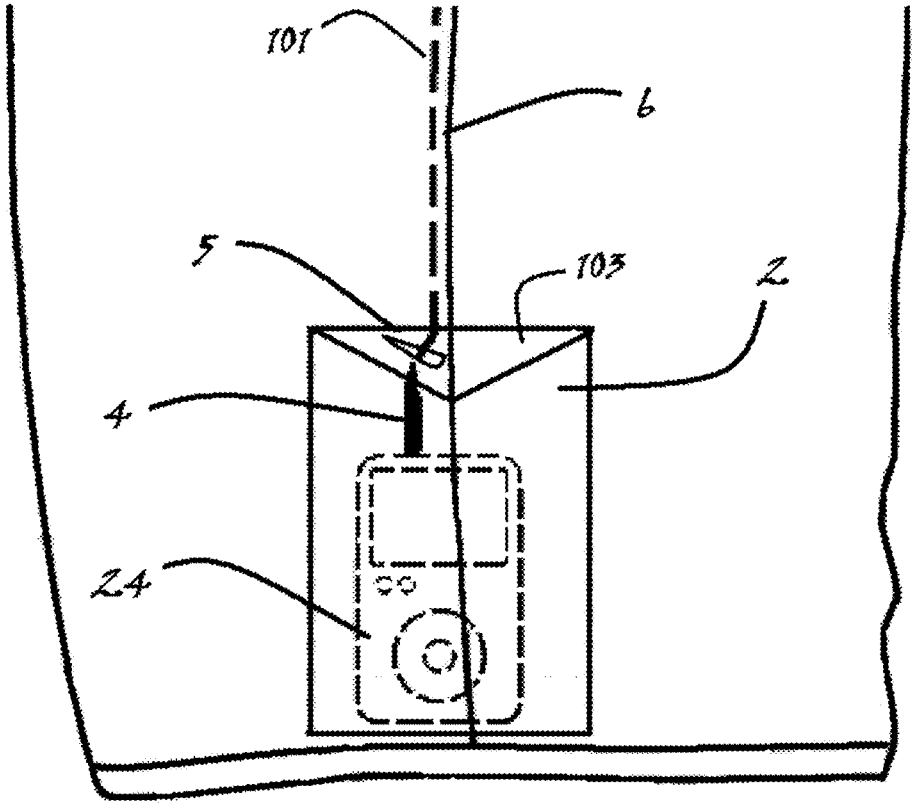
FIG. 7 illustrates a partial left side view with the extension wire device connected to an exemplary portable electronic device that is held within the pocket of the garment.

FIG. 7 illustrates a partial left side perspective view of an exemplary electronic listening device 24, held within pocket 2, attached to the earphone extension wire device 101. The female output connector port of the electronic portable listening device connected to the male TRRS connector 4 of the earphone extension wire device 101.

Figure 8:
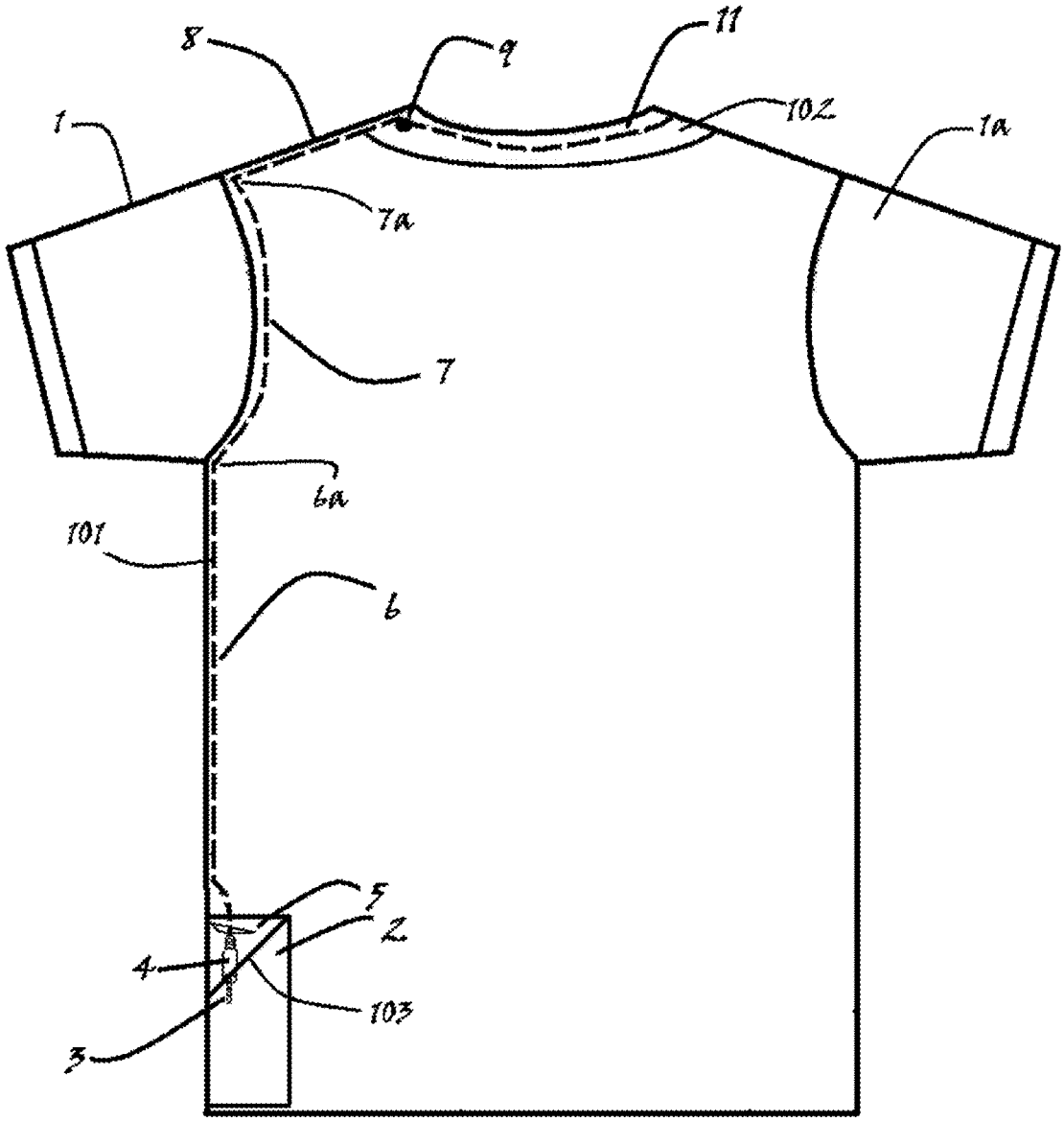
FIG. 8 illustrates a rear view of an exemplary garment with the embedded headphone extension wire device according to an embodiment of the invention.

FIG. 8 illustrates a back-side side perspective view of the combined apparel with embedded headphone extension wire device 1 exemplified with a t-shirt garment 1*a*, embedded extension wire device 101, in accordance with the present invention.

FIG. 9 illustrates an alternative function for the headphone attachment assembly 100 wherein the headphone attachment assembly 100 may be used separate and apart from the garment 1*a*. The headphone attachment assembly 100 comprised of a right and left transducer for emitting sounds with wire attachment capabilities 100*a*, 100*b* (respectively) shall connect the male connectors 16*a*, 16*b* (respectively) by inserting the connector jacks 21*a*, 21*b* (respectively) respectively into the female connectors 25*a*, 25*b* (respectively), of 'Y' adapter 26. 'Y' adapter 26 shall have affixed to it a lanyard 27 leading from adapter 26 to the male connector 29. 'Y' adapter 26 shall have connected the left channel/right channel cable 28 leading from adapter 26 to the male connector 29, and embedded within the hollowed lanyard 27. Connector 29 shall have a male TRRS connector jack 30 to be inserted into an electronic portable listening device, not shown. Not illustrated in FIG. 9 is the availability of use with earphone/microphone attachment assembly 100*c* to utilize the feature for use with a hands-free cellular phone device. Not illustrated in FIG. 9 is the availability and utilization of the over-the-ear headphone attachment assembly 200 separate and apart from the combined apparel with embedded headphone extension wire device 1.

Other attachments now know or later to be created may be adaptable to the current invention and enhance the user's experience. For instance, an attachment device (not shown) may connect between the extension wire device 101 and the portable electronic listening device 24 that may control certain desirable features such as song play, pause, stop, volume control, and song selections. Further features such as connect/disconnect of a telephone call may be employed when the portable electronic listening device is a cellular telephone.

While the invention hereinbefore described is effectively adapted to fulfill the aforesaid objects, it is to be understood that the invention is not intended to be limited to the specific preferred embodiment of the garment with headphone extension wire device 1. Rather, it is to be taken as including all reasonable equivalents within the scope of the invention.

FIELD OF INVENTION

The present invention relates to electrical connectors. In particular for electrical connectors integrated with the use of clothing to provide a means of connectivity between portable listening devices such as mp3 players or cellular telephones connecting to headphones such as in-ear, over-the-ear, and the like.

What is claimed is:

1. A combined garment and earphones extension wire device, comprising:

a garment having a pocket to house a potable listening device, an aperture on the inside of the pocket creating passage to the interior of said garment, elongated internal passageways beginning adjacent to said pocket and leading to a top left and top right aperture in close proximity to each of the user's ear;

a headphone extension wire device includes an elongated cable wire having a first end with male connector to be connected to an audio output port of a portable electronic listening device and a dual second end extending through said top left and said top right apertures to the opposing end consisting of first left and right audio connector ports respectively;

a hollow first lanyard where said extension wire from said top left and said top right apertures to said audio connector ports threads through;

a headphone attachment assembly having a left and right earphone attachment, said left and right earphone attachments each having an earphone at one end connected to conductive wiring which extends to a second left and right audio connector ports at the opposing end;

said second left and right audio connector ports are connectable to said first left and right audio connector ports;

a hollow second lanyard wherein the conductive wiring between the earphones and the second connector ports threads through.

2. The combined garment and earphones extension wire device as recited in claim 1, wherein extension wire device includes a beginning with a male jack configured in TRRS (Tip, Ring, Ring, Sleeve) 4 conductor jack format providing conductive connection provided for left channel wire, right channel wire, common ground for both the left and right channels, and connection availability for a microphone.

3. The combined garment and earphones extension wire device as recited in claim 1, wherein extension wire device is comprised of a dual wiring designated for the left channel wire and right channel wire wherein the extension ends with dual left and right channel connector ports suspended outside the garment, enabling complementary connection jacks providing for conductive connection to a left and right transducer.

* * * * *